US007015771B2

(12) United States Patent
Pelz

(10) Patent No.: US 7,015,771 B2
(45) Date of Patent: Mar. 21, 2006

(54) DIRECTIONAL COUPLER

(75) Inventor: Dieter Pelz, Croydon (AU)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/895,839

(22) Filed: Jul. 22, 2004

(65) Prior Publication Data

US 2005/0040912 A1 Feb. 24, 2005

(30) Foreign Application Priority Data

Jul. 31, 2003 (EP) ..... 03291939

(51) Int. Cl.
*H01P 5/18* (2006.01)

(52) U.S. Cl. ..... 333/111; 333/116

(58) Field of Classification Search ..... 333/109, 333/111, 116

See application file for complete search history.

(56) References Cited

U.S. PATENT DOCUMENTS

| | | | | |
|---|---|---|---|---|
| 2,679,632 A | | 5/1954 | Bellows, Jr. | |
| 3,095,544 A | | 6/1963 | Ayer et al. | |
| 3,105,207 A | | 9/1963 | Capewell | |
| 3,166,723 A | | 1/1965 | Bock et al. | |
| 3,195,075 A | | 7/1965 | Veltrop | |
| 3,221,275 A | | 11/1965 | Wambsganss | |
| 3,363,201 A | * | 1/1968 | Isaacson | 333/111 |
| 4,001,730 A | * | 1/1977 | Spinner | 333/111 |
| 4,349,793 A | | 9/1982 | Spinner | |
| 4,635,006 A | | 1/1987 | Praba | |
| 5,570,069 A | | 10/1996 | Franke | |
| 2001/0011931 A1 | | 8/2001 | Suzuki et al. | |

FOREIGN PATENT DOCUMENTS

GB 1 272 567 A 5/1972

OTHER PUBLICATIONS

S. Cohn, Characteristic Impedances of Broadside Coupled Strip Transmission Lines, IRE MTT, Nov. 1960. pp. 633-637.

Matthaei et al, "Microwave Filters, Impedance-Matching Networks, and Coupling Structures", McGraw Hill, Chapter 13 "TEM-Mode, coupled-Transmission-Line Directional Couplers and Branch-Line Directional Couplers.".

J. Shelton, "Impedances of Offset Parallel-Coupled Strip Transmission Lines", IEEE Transactions on Microwave Theory and Techniques, IEEE, Inc., New York, Vol. 14, No. 1, 1966, pp. 7-15, XP000601768.

* cited by examiner

*Primary Examiner*—Dean Takaoka
(74) *Attorney, Agent, or Firm*—Sughrue Mion, PLLC

(57) ABSTRACT

A directional coupler uses non-metallic slotted spacers at the edges of a pair of coupled lines. The spacers are adjustable in their vertical position and thereby provide continuous coupling fine-adjustment. The spatial relationship between the coupled lines is therefore adjustable and does not depend upon extremely tight manufacturing tolerances.

6 Claims, 2 Drawing Sheets

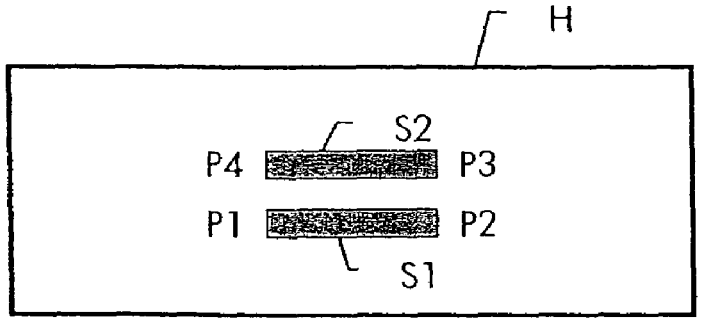
*Fig. 1* PRIOR ART
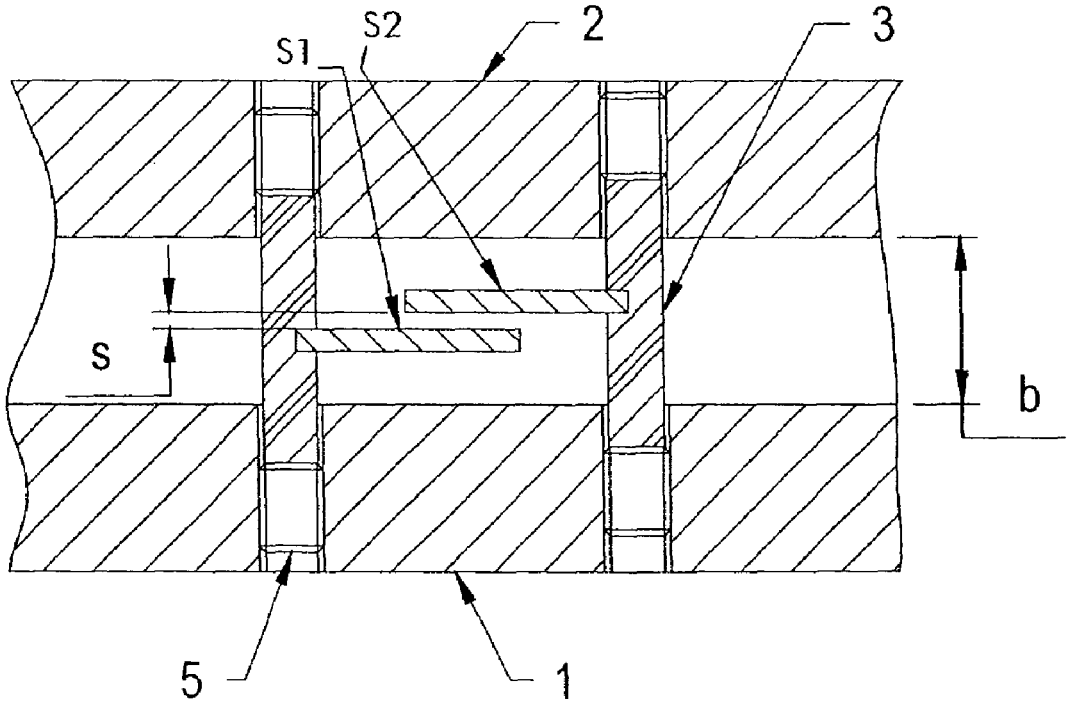
*Fig. 2*

DIRECTIONAL COUPLER

The invention is based on a priority application EP 03291939.1 which is hereby incorporated by reference.

FIELD OF THE INVENTION

The present invention relates to the field of electronics and more particularly to a directional coupler using transverse-electromagnetic mode (TEM) transmission lines for high-frequency signals.

BACKGROUND OF THE INVENTION

The basic directional coupler is a linear, passive, four port network, incorporating two parallel coupled transmission lines. A first transmission line extends between an input port and a through port, and a second transmission line extends between a coupled port and an isolated port. A signal applied to the input port propagates along the first transmission line and induces a coupled signal into the second transmission line. In so-called backward-wave couplers, the coupled signal propagates in the reverse direction with reference to the transmission line to which the input signal is applied.

A fundamental TEM directional coupler is shown in the textbook "Microwave Filters, Impedance-Matching Networks, and Coupling Structures" by Matthaei et al., McGraw Hill, Chapter 13. A directional coupler with broadside coupled striplines is described in the article "Characteristic Impedance of Broadside-Coupled Strip Transmission Lines" by S. Cohn, IRE MTT, November 1960. A directional coupler with offset broadside coupled lines is described in the article "Impedances of Offset Parallel-Coupled Strip transmission Lines" by J. P. Shelton, Jr., IEEE MTT, Vol. MTT-14, No.1, January 1966. Another directional coupler is known for example from U.S. Pat. No. 5,570,069. All these documents are herewith incorporated by reference herein.

The prescribed spatial relationship of the coupled lines in a directional coupler with broadside coupled striplines must be accurate in order to achieve the desired electrical response. In such strongly coupled lines, the gap between the lines is often very small compared to the width of the coupled lines and variations must be kept to a tolerable minimum. At the same time any metallic or non-metallic adjustment means for the coupled lines interfere with the electromagnetic fields around the lines and thereby become themselves a source of performance degradation.

It is an object of the present invention to provide a directional coupler with improved characteristics and increased production yield.

SUMMARY OF THE INVENTION

These and other objects that appear below are achieved by a directional coupler that uses non-metallic spacers connected through slots to the edges of a pair of broadside coupled lines. The spacers are adjustable in their position relative to the directional coupler housing, thereby providing continuous fine-adjustment of the gap between the lines, and hence of the coupling between the lines. The required spatial relationship between the coupled lines can therefore be achieved without extremely tight manufacturing tolerances.

Advantages: Because manufacturing tolerances can be compensated for, a production yield of close to 100% can be achieved with the adjustability given by the invention.

BRIEF DESCRIPTION OF THE DRAWINGS

Preferred embodiments of the present invention will be described below with reference to the accompanying drawings in which FIG. 1 shows a schematic cross-sectional view of conventional broadside-coupled striplines, FIG. 2 shows a cross-sectional view of broadside coupled striplines with adjustable spacers according to a first embodiment of the invention and FIG. 3 shows a 3D view of broadside coupled striplines with adjustable spacers according to a second embodiment of the invention.

DETAILED DESCRIPTION OF THE INVENTION

Figure 3:
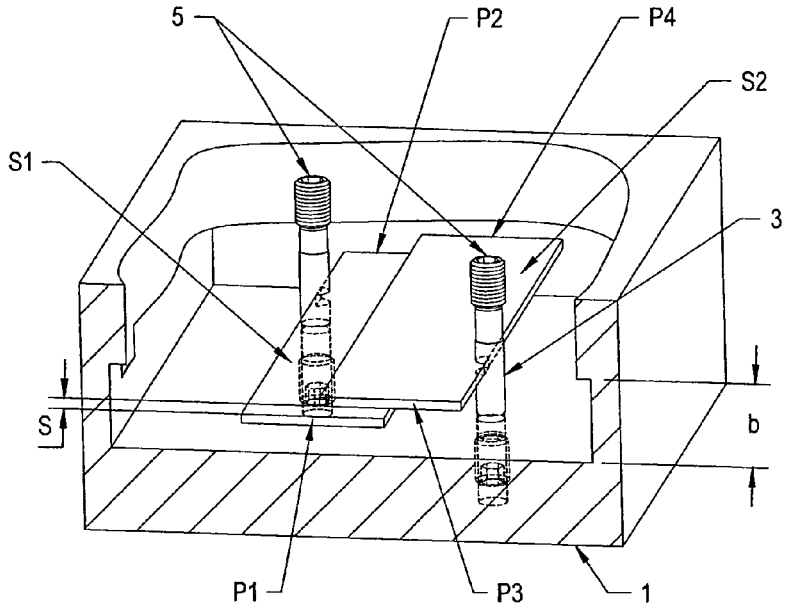

FIG. 1 shows a conventional directional coupler with broadside-coupled striplines S1 and S2 arranged in a common housing H. The striplines are parallel, adjacent transverse-electromagnetic mode (TEM) transmission lines defining four electrical ports at their respective ends where they depart from the parallelism of the striplines and where each stripline is also supported mechanically—usually soldered on to a coaxial connector (not shown in FIG. 1). The input port P1 receives an input signal from an external source (not shown) for propagation along transmission line S1 to the through port P2. The coupled port P3 emits a coupled signal induced in the reverse direction along the transmission line S2. The signal emitted from the through port P2 has (assuming an ideal, lossless structure for the coupler) a power value equal to the power value of the signal received at the input port P1 minus the power value of the coupled signal emitted at the coupled port P3. The isolated port P4 at the opposite end of the transmission line S2 from the coupled port P3 emits no signal. Reflected energy, due to impedance mismatch at either output port, appear at the isolated port P4. This isolated port P4 is normally terminated by the characteristic impedance of the coupler—typically 50 ohms.

Such coupler arrangement is suited for directional coupling, signal combining, or power splitting.

In such broadside-coupled striplines, used for example for strong coupling between lines, the gap between the lines is typically small compared to the width of the lines.

Passive microwave structures which use coupled lines in an air volume require, that the lines have a prescribed spatial relationship, e.g., a directional coupler with offset broadside coupled striplines must be accurate in order to achieve the desired electrical response. In strongly coupled striplines, the gap between the striplines is usually very small compared to the width of the striplines and variations cannot be tolerated. At the same time any metallic or non-metallic adjustment means for the coupled line interfere with the electromagnetic fields around the lines and thereby become themselves a source of performance degradation.

Non-metallic spacers are known to cater for providing accurate gaps between coupled lines, however, such spacers always constitute a local electrical discontinuity and thus an error in the even- and odd-mode impedances of the lines. These impedances on the other hand, determine the coupling k between the lines, because $$k = \frac{Z_{0even} - Z_{0odd}}{Z_{0even} + Z_{0odd}}$$

The proposed solution is based on a non-invasive external fine-tuning adjustment arrangement for the striplines.

FIG. 2 shows a first embodiment of a directional coupler according to the invention. It has first and second transmission lines S1, S2 arranged substantially parallel within a housing 1, 2 of the coupler. Each of the two transmission lines S1, S2 is fixedly attached to a corresponding non-metallic spacer 3, which is held in a corresponding hole in the housing. Set screws 5 allow to adjust the vertical position of each line within the housing and thereby adjust the gap s between the two lines. The spacers are attached through slots to the edges of the striplines. However other attachment means are likewise possible.

FIG. 3 shows in a second embodiment of the invention inner details of a directional coupler with offset broadside-coupled striplines S1 and S2 arranged in a common housing 2. As in the embodiment before, each of the two transmission lines S1, S2 is fixedly attached to a corresponding non-metallic spacer 3, which is held in a corresponding hole in the housing 1. Set screws 5 allow to adjust the vertical position of each line within the housing 1 and thereby adjust the gap s between the two lines. Not shown in the figures are the port sections, where there is a departure from coupling to transmission, as these sections are not subject to the invention. The transmission sections may also provide further mechanical support for the striplines.

For ease of manufacture, parallelism is usually required and therefore, especially in broadband couplers with varying coupling along the line, the coupling is set by the amount of overlap between the lines (see FIG. 3) while the gap s between the lines is constant. The most critical dimension in the described coupled-line arrangement is the gap s between the two striplines. A small change in the gap size directly translates to a strong change in the odd-mode impedance of the lines and thus a change in the coupling factor k. A change in the position of the striplines with reference to the top- and bottom groundplane given as part of the housing 1, affects mainly the even-mode impedance and thereby it also affects the coupling, but the stronger effect is on the port-VSWR of the stripline. At the same time, manufacturing tolerances always lead to a certain amount of distortion of the nominal spatial relationships. The invention hence recognizes a need to have an adjustment means for the stripline's vertical positioning. This is especially important in couplers where a certain coupling value is to be closely maintained over a given frequency band.

Such vertical stripline adjustment is provided by the invention. Non-metallic spacers 3, fixedly attached to the striplines S1, S2 via a horizontal slot are held in top- and bottom holes in the coupler's housing 1. The holes are partially- or fully threaded and the vertical adjustment of the striplines is provided by adjusting the vertical position of the spacers with externally accessible set screws 5 without intrusive action. By adjusting both spacers, the dimension of the critical gap s between the striplines as well as the vertical position of both striplines can be accurately set, at the time of measurement of the electrical performance of the device and thereby the performance of the device can be optimized quickly and easily. The chosen spacer arrangement minimizes the local electrical discontinuity and thus minimally disturbs the coupling and the impedance. Unlike large discontinuities which would occur using standard spacer methods, the small discontinuity introduced by this arrangement can be compensated by known techniques to minimize impact on the coupling, namely small cutouts on the stripline adjacent to the spacer.

The spacers 5 can be made for example of an ceramic material or plastic such as polyamide. The invention is applicable to all devices using coupled transmission lines in an air volume. The invention may be applied to offset broadside-coupled lines as well as to non-offset striplines.

Having read the above description, those skilled in the art will appreciate that various modifications and alterations would be possible to the above embodiments, without departing from the basic principles of the invention. For example, in the above embodiments, the spacer adjustability is presently in the vertical axis only. Alternatively, it would rather be possible to make the spacers adjustable at an angle.

What is claimed is:

1. A directional coupler comprising a pair of transmission lines arranged in a housing with a gap between the two transmission lines; wherein at least one of said transmission lines is fixedly attached to a non-metallic spacer adjustably held in a corresponding hole in said housing, wherein said transmission lines are substantially parallel and wherein said spacer is movable with respect to said housing along an axis perpendicular to said transmission lines.

2. A directional coupler according to claim 1, further comprising at least one set screw arranged to allow adjustment of the corresponding spacer.

3. A directional coupler according to claim 1, wherein the spacer is attached to its transmission line by a slot in said spacer.

4. A directional coupler according to claim 1, further comprising a second spacer attached to the second of said two transmission lines and being adjustably held in a corresponding second hole in the housing.

5. A directional coupler according to claim 1, further comprising a second spacer attached to the second of said two transmission lines and being adjustably held in a corresponding second hole in the housing and wherein said first and second spacers allow adjustment of the two transmission lines with reference to top and bottom inner groundplanes of the housing.

6. A directional coupler according to claim 1, wherein said first and second transmission lines are TEM transmission media.

* * * * *